US005098551A

United States Patent [19]

Bertaux et al.

[11] Patent Number: 5,098,551

[45] Date of Patent: Mar. 24, 1992

[54] PROCESS FOR THE MANUFACTURE OF LUBRICATING BASE OILS

[76] Inventors: Jean-Marie A. Bertaux; Jean-Claude M. Holley; Martinus M. P. Janssen, all of Centre de Recherche, Route de Caen, 76530 Grand Couronne, France

[21] Appl. No.: 523,806

[22] Filed: May 16, 1990

[30] Foreign Application Priority Data

May 30, 1989 [FR] France ..... 89 07076

[51] Int. Cl.[5] ..... C10G 23/04; C10G 47/00

[52] U.S. Cl. ..... 208/111; 208/46; 208/135; 208/136; 208/137; 208/27; 208/31

[58] Field of Search ..... 208/27, 31, 134, 111; 585/737, 738, 739

[56] References Cited

U.S. PATENT DOCUMENTS

| | | | |
|---|---|---|---|
| 3,658,689 | 4/1972 | Steinmetz et al. | 208/46 |
| 3,861,005 | 1/1975 | Steinmetz et al. | 208/111 |
| 4,419,220 | 12/1983 | LaPierre | 208/111 |
| 4,747,932 | 5/1988 | Miller | 208/111 |
| 4,822,476 | 4/1984 | Ziemer et al. | 208/143 |

FOREIGN PATENT DOCUMENTS

| | | |
|---|---|---|
| 19980 | 12/1980 | European Pat. Off. . |
| 104807 | 4/1984 | European Pat. Off. . |
| 178710 | 4/1986 | European Pat. Off. . |
| 752925 | 7/1956 | United Kingdom . |
| 1429291 | 3/1976 | United Kingdom . |
| 1493620 | 11/1977 | United Kingdom . |
| 1546398 | 5/1979 | United Kingdom . |

OTHER PUBLICATIONS

Karzhev et al., Proceedings of 9th World Petroleum Congress, vol. 5, Processing and Storage, pp. 191-196.

*Primary Examiner*—Helane Myers

[57] ABSTRACT

Lubricating base oils having a high viscosity index, preferably at least 135, are manufactured by catalytic hydroisomerization of a hydrocarbonaceous feedstock, derived from a waxy crude oil, which feedstock has not been treated to remove a lubricating base oil fraction and which feedstock contains at least 30% by weight wax and has at least 80% by weight boiling above 300° C. and at most 30% by weight boiling above 540° C.

9 Claims, No Drawings

PROCESS FOR THE MANUFACTURE OF LUBRICATING BASE OILS

The present invention relates to a process for the manufacture of lubricating base oils and is particularly concerned with the manufacture of lubricating base oils having a very high viscosity index.

Lubricating base oils, which are used for example to formulate engine lubricants and industrial oils, are normally prepared from suitable petroleum feedstocks by a variety of refining processes which are generally directed to obtaining a lubricating base oil with a predetermined set of properties, for example viscosity, oxidation stability and maintenance of fluidity over a wide range of temperatures (as indicated by viscosity index).

The preparation of lubricating base oils is conventionally carried out as follows. A crude oil is separated by distillation at atmospheric pressure into a number of distillate fractions and a residue, known as long residue. The long residue is then separated by distillation at reduced pressure into a number of vacuum distillates and a vacuum residue known as short residue. From the vacuum distillate fractions lubricating base oils are prepared by refining processes. By these processes aromatics and wax are removed from the vacuum distillate fractions. From the short residue asphalt can be removed by known deasphalting processes. From the deasphalted oil thus obtained aromatics and wax can subsequently be removed to yield a residual lubricating base oil, known as bright stock. The wax obtained during refining of the various lubricating base oil fractions is designated as slack wax.

Lubricating base oils of the desired properties are obtained from suitable vacuum distillate fractions and/or from deasphalted oil by suitable refining processes, including catalytic and solvent dewaxing processes and catalytic hydrotreatment as described in EP-A-178710. While it is possible to obtain high viscosity index base oils in this way, very high viscosity index base oils (having a viscosity index of at least 135) cannot be obtained directly by such processes. Instead, they are obtained by hydrotreatment of the slack wax by-product of the refining operations.

There is an increasing demand for lubricating base oils of very high viscosity index in contrast to those of lower viscosity index. Clearly such increased demand cannot readily be met by processing by-product slack wax obtained in the production of lower viscosity index base oils.

Surprisingly we have found that very high viscosity index lubricating base oils can be obtained directly from high wax containing feedstocks derived from waxy crude oils. Such waxy crudes have previously been regarded as unsatisfactory for the production of lubricating base oils since the yield of medium and high viscosity index base oils is low. This is illustrated, for example, by U.S. Pat. Nos. 3,658,689 and 3,861,005, which describe the use of certain zeolite catalysts of a type suited for hydrocracking in the conversion of waxy hydrocarbons to oils in the lubricating oil viscosity range. Oils of only low to medium viscosity are produced, apparently only in low yield even when wax itself is used as feedstock for the conversion.

The present invention relates therefore to a process for the manufacture of lubricating base oils having a high viscosity index, preferably at least 135 (as determined by ASTM D-2270) and more preferably of at least 140, comprising contacting a hydrocarbonaceous feedstock, derived from a waxy crude oil, which feedstock has not been treated to remove a lubricating base oil fraction and which feedstock contains at least 30% by weight wax and has at least 80% by weight boiling above 300° C. and at most 30% by weight boiling above 540° C., with a hydroisomerization catalyst under hydroisomerizing conditions and subsequently recovering a lubricating base oil having a high viscosity index.

The feedstock may be derived from any crude oil having a relatively high wax content. Examples of such crudes are Gippsland, Bu Attifel, Bombay High, Minas, Cinta, Taching, Udang, Sirikit and Handil. The feedstock employed may suitably be the long residue itself or a distillate fraction thereof dependent on the nature of the crude oil. Suitable feedstocks include, for example, flashed distillates having a boiling range of 300° C.-600° C., preferably 350° C.-550° C., or a further vacuum distillate fraction thereof.

Although the initial feedstock, derived from waxy crude, has not been deoiled, and thus not subjected to removal of any other lubricating oil fractions, the feedstock may have been treated to remove undesirable contaminants, for example to reduce the nitrogen content by solvent extraction or to reduce the asphaltenes content by deasphalting.

Such denitrification may be carried out with solvents such as furfural, phenol or N-methyl-2-pyrrolidone, all having boiling points well below the boiling range of the desired lubricating base oil so that separation and recovery of the solvent applied is possible by simple flashing. Preference is given to the use of furfural as extractant. In view of the high cost of solvent recovery and the relatively low value of the extract produced, it is important that the maximum amount of raffinate should be produced with the minimum use of solvent. Very good results can be obtained using a rotating disc contactor in the extraction process, especially when the temperature at which the extraction process is carried out is carefully maintained.

The solvent extraction is normally carried out for furfural at temperatures in the range of from 50° C.-135° C., depending on the type of distillate to be extracted. Relatively lower boiling distillates are extracted at lower temperatures than higher boiling distillates. Solvent/feed ratios of from 0.4 to 4 can be normally applied for furfural as extractant. By carefully adjusting the temperature and/or the solvent/feed ratio to be applied, the extraction depth can be set at the required level. By raising the temperature and/or the solvent/feed ratio the extraction depth will be increased.

It is preferred to reduce the nitrogen content of the feedstock to less than 200 ppm, more preferably less than 100 ppm, before carrying out the catalytic hydroisomerisation.

The conditions and catalyst for hydroisomerization are selected so that the feedstock is primarily isomerized with substantial retention of molecular weight with minimum hydrocracking to products of lower molecular weight.

The hydroisomerisation according to the present invention can be carried out suitably at a temperature in the range of from 290° C. to 425° C., and preferably in the range from 325° C. to 400° C. Hydrogen pressures in the range of from 25 to 300 bar can be suitably applied. Preference is given to the use of pressures in the range of from 90 to 160 bar, in particular in the range of from 100 to 150 bar. Suitable space velocities are from 0.5 to 1.5 $t/m^3 \cdot h$. Preference is given to the use of a space velocity in the range of 0.5 to 1.2 $t/m^3/h$.

Pure hydrogen may be used but this is not necessary. A gas with a hydrogen content of 60% or more by volume is perfectly suitable. In practice it will be preferable to use a hydrogen-containing gas originating from a catalytic reforming plant. Such a gas not only has a high hydrogen content but also contains low-boiling hydrocarbons, for example methane, and a small quantity of propane. The hydrogen/oil ratio to be applied is suitably in the range between 300 and 5,000 standard liters (liters at 1 bar and 0° C.) per kg of oil. Preference is given to the use of hydrogen/oil ratios between 500 and 2,500 standard liters per kg of oil, in particular between 500 and 2,000 standard liters per kg of oil.

Preferred catalysts which can be suitably applied in the hydroisomerisation stage of the process according to the present invention comprise one or more metals of Groups VI B and VIII of the Periodic Table of the Elements, or sulphides or oxides thereof, which may be supported on a carrier comprising one or more oxides of elements of Groups II, III and IV of the Periodic Table of the Elements, which catalysts may also comprise one or more promoters. Preference is given to catalysts comprising one or more of the metals molybdenum, chromium, tungsten, platinum, palladium, nickel, iron and cobalt or their oxides and/or sulphides, either supported on a suitable carrier, or unsupported. Particularly advantageous catalysts comprise combinations of one or more Group VIII metals (iron, cobalt, nickel) and one or more Group VI B metals (chromium, molybdenum and tungsten) such as cobalt and molybdenum, nickel and tungsten and nickel and molybdenum supported on alumina and nickel and molybdenum supported a silica-alumina.

The catalysts are preferably used in their sulphidic form. Sulphidation of the catalysts may be effected by any one of the techniques for sulphidation of catalysts well known in the art. Sulphidation may, for instance, be carried out by contacting the catalysts with a sulphur-containing gas, such as a mixture of hydrogen and hydrogen sulphide, a mixture of hydrogen and carbon disulphide or a mixture of hydrogen and a mercaptan, such as butyl mercaptan. Sulphidation may also be carried out by contacting the catalyst with hydrogen and a sulphur-containing hydrocarbon oil, such as a sulphur-containing kerosine or gas oil.

The catalysts may also contain one or more promoters. Suitable promoters comprise compounds containing phosphorus, fluorine or boron. The use of these promoters is often advantageous in terms of catalyst activity, selectivity and stability.

Examples of suitable supports for the catalysts to be used in the hydroisomerizing stage comprise silica, alumina, zirconia, thoria and boria, as well as mixtures of these oxides, such as silica-alumina, silica-magnesia and silica-zirconia. Preference is given to catalysts comprising alumina as carrier material.

The metals or metal compounds may be incorporated into catalysts by any one of the techniques for the preparation of supported catalysts well known in the art. The metals or metal compounds are preferably incorporated into the catalysts by (co)-impregnation of a carrier in one or more steps with an aqueous solution containing one or more metal compounds, followed by drying and calcining. If the impregnation is carried out in several steps, the material may be dried and calcined between the successive impregnation steps.

The amounts of the metals present in the catalysts may vary between wide limits. Very suitably, the catalysts contain at least 10 parts by weight of a Group VI B metal and/or at least 3 parts by weight of a Group VIII metal per 100 parts by weight of carrier. Amounts as high as 100 parts by weight of a Group VI B metal and/or a Group VIII metal per 100 parts by weight of carrier can also be used.

Preferred catalysts to be used in the hydroisomerization are those described in British patent specifications 1,493,620 and 1,546,398. The catalysts described therein are fluorine-containing catalysts containing either nickel and/or cobalt and, in addition, molybdenum, nickel and tungsten on alumina as carrier, which catalysts have a compacted bulk density of at least 0.8 g/ml, comprise at least 3 parts by weight of nickel and/or cobalt, 10 parts by weight of molybdenum and 20 parts by weight of tungsten, respectively, per 100 parts by weight of carrier, and have been prepared from an alumina hydrogel from which, by drying and calcining, a xerogel can be obtained having a compacted bulk density of less than 0.8 g/ml and wherein the preparation of the catalyst is effected a) if the pore volume quotient of the said xerogel is at least 0.5 either (i) by drying and calcining the alumina hydrogel, incorporation of nickel and tungsten into the xerogel and once more drying and calcining the composition, or (ii) by incorporation of the metals into the alumina hydrogel, and drying and calcining the composition b) if the pore volume quotient of the said xerogel is less than 0.5 either (i) by incorporation of at least part of the fluorine into the alumina hydrogel, and drying and/or calcining the composition, incorporation of nickel and tungsten into the xerogel and once more drying and calcining the composition, or (ii) by incorporation of the metals and at least part of the fluorine into the alumina hydrogel, and drying and calcining the composition; a further condition being that if in the catalyst preparation the starting material is an alumina hydrogel with a pore volume quotient of less than 0.5 sufficient fluorine should be incorporated into the alumina hydrogel to be able to produce from this fluorine-containing alumina hydrogel, by drying and calcining, a xerogel having a pore volume quotient of at least 0.5. (For a further description of the pore volume quotient reference is made to the abovementioned British Patent Specifications.).

If in the hydroisomerizing process according to the present invention a catalyst is employed comprising nickel and tungsten and which has been prepared by the xerogel route (i.e. by incorporation of the metals into the xerogel) preference is given to a catalyst comprising 3–12 parts by weight of nickel and 20–75 parts by weight of tungsten per 100 parts by weight of alumina and in particular to such a catalyst in which the nickel-to-tungsten weight ratio is between 1:5 and 1:7.

If in the hydroisomerizing stage of the process according to the present invention a catalyst is employed comprising nickel and tungsten and which has been prepared by the hydrogel route (i.e. by incorporation of the metals into the hydrogel), preference is given to a catalyst comprising 25–50 parts by weight of nickel and 50–80 parts by weight of tungsten per 100 parts by weight of alumina and in particular to such a catalyst in which the nickel-to-tungsten weight ratio is between 1:1.5 and 1:5.

If in the hydroisomerizing stage of the process according to the present invention a catalyst is employed comprising nickel and/or cobalt, and, in addition, molybdenum, preference is given to a catalyst comprising 25–80 parts by weight of nickel and/or cobalt and 50–80 parts by weight of molybdenum per 100 parts by weight of alumina and in particular to such a catalyst in which the weight ratio between nickel and/or cobalt on the one hand and molybdenum on the other is between 1:1 and 1:5.

The quantity of fluorine present in the aforementioned catalysts is preferably 0.5–10 parts by weight per 100 parts by weight of alumina if they have been prepared by the xerogel route and 10–25 parts by weight per 100 parts by weight of alumina if they have been prepared by the hydrogel route.

Part or all of the fluorine compound, as the case may be, may very suitably be incorporated into the catalyst by in-situ fluorination which may be carried out by adding a suitable fluorine compound, such as o-fluoro toluene or difluoro ethane to the gas and/or liquid stream which is passed over the catalyst.

The desired lubricating base oil having a high viscosity index, preferably of at least 135, may be recovered by known techniques such as solvent dewaxing and catalytic dewaxing. Processing steps such as hydrofinishing may also be employed.

Solvent dewaxing is suitably carried out by using two solvents, one of which dissolves the oil and maintains fluidity at low temperatures (methyl isobutyl ketone and, in particular, toluene being well-known solvents for this purpose) and the other which dissolves little wax at low temperatures and which acts as a wax precipitating agent (methyl ethyl ketone being a well-known agent for this purpose). Propane and chlorinated hydrocarbons such as dichloromethane can also be used. Normally, the product to be dewaxed is mixed with the solvents and heated to ensure solution. The mixture is then cooled down to filtration temperature, usually in the range of from −10° C. to −40° C. The cooled mixture is then filtrated and the separated wax washed with cooled solvent. Finally, the solvents are recovered from the dewaxed oil and from the separated wax by filtration and recirculation of the solvents into the process.

Catalytic dewaxing is suitably carried out by contacting the hydrotreated product produced according to the hydroisomerisation process in the presence of hydrogen with an appropriate catalyst. Suitable catalysts comprise crystalline aluminium silicates such as ZSM-5 and related compounds, e.g. ZSM-8, ZSM-11, ZSM-23 and ZSM-35 as well as ferrierite type compounds. Good results can also be obtained using composite crystalline aluminium silicates wherein various crystalline structures appear to be present.

The catalytic hydrodewaxing may very suitably be carried out at a temperature of from 250° C.–500° C., a hydrogen pressure of from 5–100 bar, a space velocity of from 0.1–5.0 $kg.l^{-1}.h^{-1}$ and a hydrogen/oil ratio of from 100–2,500 standard liters per kilogram of oil. The catalytic hydrodewaxing is preferably carried out at a temperature of from 275° C. –450° C., a hydrogen pressure of from 10–75 bar, a space velocity of from 0.2–3 $kg.^{-1}.h^{-1}$ and a hydrogen/oil ratio of from 200–2,000 standard liters per kilogram.

It is also possible, though not required, to subject the lubricating base oil manufactured in accordance with the present invention to an aftertreatment, e.g. a hydrofinishing treatment using rather mild hydrogenation conditions or mild extraction to improve certain properties, e.g. resistance to oxidation.

The base oil produced according to the process of the present invention can be suitably applied to formulate lubricating oils for many applications, if desired together with one or more base oil fractions of adequate quality which have been obtained via different processes.

The invention will now be illustrated with reference to the following examples.

EXAMPLE 1

In order to produce a lubricating base oil having a viscosity index higher than 140 and a kinematic viscosity of 3.8 cSt at 100° C., a flashed distillate distilled from a Gippsland long residue and having a total nitrogen content of 351 mg/kg and a wax content of 51% by weight was subjected to a furfural extraction treatment prior to catalytic hydrotreatment. This flashed distillate featured the following boiling points: 10% by weight at 387° C., 50% by weight at 425° C. and 90% by weight at 474° C. Its extraction was carried out at a temperature of 90° C. and a solvent/feed ratio of 3.2.

The intermediate waxy raffinate produced had a total organic nitrogen content of 15 mg/kg and a wax content of 65% by weight. This waxy raffinate gave the following boiling points: 10% by weight at 386° C., 50% by weight at 426° C. and 90% by weight at 476° C. The intermediate waxy raffinate was then catalytically hydrotreated using a fluorided nickel/tungsten on alumina catalyst containing 5% by weight of nickel (6.3% by weight of NiO) and 23% by weight of tungsten (29% by weight of $WO_3$) and 2.9% by weight of fluorine.

The catalytic treatment was carried out at a hydrogen partial pressure at the reactor inlet of 120 bar, a space velocity of 0.81 $t/m^3.h$ and at a temperature of 370° C.

After solvent dewaxing at −23° C. of the redistilled total liquid product obtained by the catalytic hydrotreatment, a 3.78 cSt lubricating base oil was produced in a yield of 14.9% by weight on the long residue intake. The dewaxed base oil had a VI of 143 and a pour point below −12° C.

EXAMPLE 2

A flashed distillate from Gippsland long residue having the properties described in Example 1 was subjected to a furfural extraction at a temperature of 90° C. and a solvent/feed ratio of 1.0.

The intermediate waxy raffinate produced had a total organic nitrogen content of 56 mg/kg and a wax content of 58% by weight. This waxy raffinate gave the following boiling points: 10% by weight at 383° C., 50% by weight at 426° C. and 90% by weight at 476° C. The intermediate waxy raffinate was then catalytically hydrotreated using the catalyst as described in Example 1.

The catalytic treatment was carried out at a hydrogen partial pressure at the reactor inlet of 120 bar, a space velocity of 0.80 $t/m^3.h$ and at a temperature of 380° C.

After solvent dewaxing at −23° C. of the redistilled total liquid product obtained by the catalytic hydrotreatment, a 3.71 cSt lubricating base oil was produced in a yield of 15.1% by weight on the long residue intake. The dewaxed base oil had a VI of 145 and a pour point below −12° C.

EXAMPLE 3

In order to produce a lubricating base oil having a viscosity index higher than 140 and a kinematic viscosity of 3.8 cSt at 100° C., a Gippsland long residue having a total nitrogen content of 424 mg/kg and a wax content of 50% by weight was subjected to a furfural extraction treatment prior to catalytic hydrotreatment. This long residue featured the following boiling points: 10% by weight at 341° C., 50% by weight at 425° C. and 82% by weight at 524° C. The extraction was carried out at a temperature of 130° C. and a solvent/feed ratio of 5.0.

The intermediate waxy raffinate produced had a total organic nitrogen content of 81 mg/kg and a wax content of 65% by weight. This waxy raffinate gave the following boiling points: 10% by weight at 358° C., 50% by weight at 437° C. and 77% by weight at 521° C. The intermediate waxy raffinate was then catalytically hydrotreated using a fluorided nickel/tungsten on alumina catalyst containing 5% by weight of nickel (6.3% by weight of NiO) and 23% by weight of tungsten (29% by weight of $WO_3$) and 2.9% by weight of fluorine.

The catalytic treatment was carried out at a hydrogen partial pressure at the reactor inlet of 120 bar, a space velocity of 0.81 $t/m^3 \cdot h$ and at a temperature of 395° C.

After solvent dewaxing at −23° C. of the redistilled total liquid product obtained by the catalytic hydrotreatment, a 3.73 cSt lubricating base oil was produced in a yield of 23.8% by weight on the long residue intake. The dewaxed base oil had a VI of 145 and a pour point below −9° C.

We claim:

1. A process for the manufacture of lubricating base oils having a high viscosity index, comprising contacting a hydrocarbonaceous feedstock with a hydroisomerization catalyst comprising one or more metals of Groups VI B and VIII of the Periodic Table of the Elements, or sulphides or oxides thereof, supported on a carrier comprising one or more oxides of elements of Groups II, III and IVC of said Periodic Table, under hydroisomerizing conditions and subsequently recovering said lubricating base oil having a viscosity index of at least 135, said hydrocarbonaceous feedstock comprising a long residue or a flashed distillate thereof derived from a waxy crude oil, which feedstock has not previously been treated to remove a lubricating base oil fraction and which feedstock contains at least 30% by weight wax and has at least 80% by weight boiling above 300°0 C. and at most 30% by weight boiling above 540° C.

2. A process according to claim 1 wherein the hydrocarbonaceous feedstock is the flashed distillate of the long residue, having a boiling range of 300° C. to 600°0 C.

3. A process according to claim 1 wherein the feedstock is subjected to solvent extraction prior to hydroisomerization to reduce the nitrogen content thereof to less than 200 ppm.

4. A process according to claim 1 wherein the hydroisomerisation is carried out at a temperature in the range of 290° C. to 425° C., a hydrogen pressure in the range of 25 to 300 bar, a space velocity of 0.5 to 1.5 $t/m^3 \cdot h$ and a hydrogen/feedstock ratio in the range of 300 to 5,000 standard liters per kg of oil.

5. A process according to claim 1 wherein the catalyst comprises nickel and/or cobalt and molybdenum and/or tungsten.

6. A process according to claim 1 wherein the hydroisomerization catalyst also contains phosphorus or fluorine.

7. A process according to claim 1 wherein the recovery of the lubricating base oil comprises a solvent dewaxing or catalytic dewaxing step.

8. A process according to claim 7 wherein the recovery of the lubricating base oil comprises a solvent dewaxing using toluene and methyl ethyl ketone as solvent and precipitating agent respectively.

9. A process according to claim 1 wherein said hydroisomerisation is carried out at a temperature of between 325° C. to 425° C.

* * * * *